US005990672A

United States Patent [19]

Giacomini

[11] Patent Number: 5,990,672

[45] Date of Patent: Nov. 23, 1999

[54] GENERATOR CIRCUIT FOR A REFERENCE VOLTAGE THAT IS INDEPENDENT OF TEMPERATURE VARIATIONS

[75] Inventor: Davide Giacomini, Valdengo, Italy

[73] Assignee: STMicroelectronics, S.r.L., Agrate Brianza, Italy

[21] Appl. No.: 09/170,612

[22] Filed: Oct. 13, 1998

[30] Foreign Application Priority Data

Oct. 14, 1997 [IT] Italy ..... VA97 A 0033

[51] Int. Cl.[6] ..... G05F 3/16

[52] U.S. Cl. ..... 323/313; 323/907

[58] Field of Search ..... 323/313, 314, 323/907

[56] References Cited

U.S. PATENT DOCUMENTS

| | | | |
|---|---|---|---|
| 4,250,445 | 2/1981 | Brokaw | 323/313 |
| 4,524,318 | 6/1985 | Burnham et al. | 323/313 |
| 4,525,663 | 6/1985 | Henry | 323/313 |
| 4,645,948 | 2/1987 | Morris et al. | 307/296 R |
| 4,954,769 | 9/1990 | Kalthoff | 323/313 |
| 5,485,074 | 1/1996 | Tomasini et al. | 323/315 |
| 5,512,817 | 4/1996 | Nagaraj | 323/316 |
| 5,563,503 | 10/1996 | Ng et al. | 323/315 |
| 5,691,663 | 11/1997 | Nayebi et al. | 327/560 |

*Primary Examiner*—Peter S. Wong
*Assistant Examiner*—Bao Q. Vu
*Attorney, Agent, or Firm*—Allen, Dyer, Doppelt, Milbrath & Gilchrist, P.A.

[57] ABSTRACT

A generator circuit for a reference voltage independent of temperature variations uses a Brokaw cell biased by a current generator. The generator circuit includes a start-up circuit for delivering a current to the load of the generator using a transistor from the power-on instant until the switching on of the Brokaw cell and the consequent switching-off of the transistor. The circuit further includes a first field effect transistor having a gate coupled to a bandgap voltage node of the Brokaw cell and operatively connected in series with at least one diode between a biasing current generator of the start-up circuit and ground. The circuit also includes a second bipolar junction transistor having a base coupled to the power supply node of the Brokaw cell and operatively connected to a load resistance that is, in turn, connected to the supply rail and to the output transistor of the Brokaw cell for supplying current to the load during the start-up phase.

16 Claims, 4 Drawing Sheets

VBAT
Vbat
biosRef
Vas
Vas
Q1
Q2
Q3
Q5
Q8
Q9
Q10
Q11
Q13
Q14
M2
M3
M4
M5
M5
PB
R7
Ibias>=1uA
PB
RD
PB
RA
PB
RB
RC
VBG
Vbg
Vbg
C
+
-
R1
R2
R3
R4
R5
R6
noPWF
PWPF
50K
100K
200K
400K
400K
400K
MAX INPUT VOLTAGE VINMAX=30V
MIN INPUT VOLTAGE VINMIN=3.5V Q14
Q8
Vbg
VBG
C
RC
M5
M3
M2
Q11
Q13
Vbg
PB
RA
PB
RB
Q9
MAX INPUT VOLTAGE VINMAX=30V
MIN INPUT VOLTAGE VINMIN=3.5V
PB
R7
Q2
Ibias>=5uA
M4
Q10
Q1
vbat
VBAT
biasRef
noPWF
PWPF
R1
R2
R3
R4
R5
R6
50K
100K
200K
400K
400K
400K
Vas
Vas

GENERATOR CIRCUIT FOR A REFERENCE VOLTAGE THAT IS INDEPENDENT OF TEMPERATURE VARIATIONS

FIELD OF THE INVENTION

The invention relates to a circuit for generating a noise free stable bandgap reference voltage with a high PSRR (Power Supply Rejection Ratio).

BACKGROUND OF THE INVENTION

Higher and higher precision is constantly required for either power supply circuits or level control circuits employing comparators or amplifiers. In all instances, it is of fundamental importance to establish a reference voltage upon which such functional circuits may be based. Such reference voltages should be highly stable with respect to temperature changes and to shifts of the supply voltage. Such reference voltages should also be essentially free from noise that may come from the supply lines. In addition, such circuits should be capable of delivering a sufficient current to an output load.

Many integrated circuits have been implemented in an attempt to obtain stable voltage references with a high PSRR. The common approach is to stabilize the supply voltage of a so-called bandgap cell, thus averting the Early effect of the bipolar junction transistors and or the body effect of field effect transistors used in the cell. These effects would otherwise cause slight variations in the output voltage provided by the bandgap cell. There are numerous articles on these topics although perhaps the most popular approach is based on the use of the so-called Brokaw cell. Mr. Barrie Gilbert of Analog Devices thoroughly described this approach during the "Low-power Low-Voltage Analog IC Design" workshop held in Lausanne in June 1996. Upon analyzing the basic circuit of the Brokaw cell, many approaches have been proposed and FIG. 1 shows a typical circuit implementation, which, in any case, has few drawbacks.

As shown in FIG. 3, by observing the evolution of the output voltage at start up, most of the circuits of the prior art show a characteristic along which two different slopes may be clearly identified. By referring to the scheme of FIG. 1, a bandgap cell (or Brokaw cell) requires a certain current to be activated. Therefore, a bipolar junction transistor (BJT) Q9 is normally present to force an adequate current through the cell circuit. However, the collectors of the transistors Q13 and Q11 initially are at null voltage, and this determines that if their base voltage increases, the associated pnp parasitic transistor is turned on. In this case, if the base bias current of these transistors, which originate from Q8 and Q9, is not greater than the current leaked toward the substrate by the parasitic pnp transistor, the npn pair will not come out of saturation and the bandgap cell will not start up. Instead, it will remain blocked at a voltage of about 0.6–0.7v, that is, at the Vbe of the parasitic pnp.

Of course, if the design is correct, the circuit will start up, but the output voltage will not increase linearly because the Vbg voltage has not exceeded 0.6V (that is, the previously cited critical value). The circuit is then only capable of supplying a small amount of current to the load capacitance, and, thus, the Vbg voltage on the associated node of the cell increases slowly. At a certain point, the pair of transistors of the bandgap cell turn on definitely and the voltage grows rapidly towards its final value. This is so because the output transistor of the Q8 cell also begins to deliver current to the load. This typical output voltage characteristic is depicted in FIG. 3.

It appears evident that besides the parasitic pnp transistor, an accidental cause for a missed start-up may be an excessive load on the circuit output during the start-up phase. This is so because the excessive load draws current from the bases of the npn pair of the cell, thus enhancing the undesired effect of their parasitic pnp transistor.

SUMMARY OF THE INVENTION

The circuit of the invention overcomes these problems while ensuring an increased capacity of supplying current to the load from the first instant of the start-up.

The circuit of the invention comprises a field effect transistor with its own gate connected to the bandgap voltage node of the Brokaw cell, operatively connected in series between two diodes that, in series with a current generator, provide a branch of the start-up circuit of the Brokaw cell. Moreover, the circuit comprises a bipolar junction transistor having a base connected to the supply node of the Brokaw cell circuit by way of a current generator, and being operatively connected to the supply node of the circuit through a load resistance and to the output transistor of the Brokaw cell to primarily supply current to the load during the start-up phase, upon switching the circuit on.

To prevent output voltage overshoot at start-up, a field effect transistor is also employed with a gate coupled to the collector of the bipolar junction transistor. A source is coupled to the supply node and a drain is connected to the control node of a transistor driving the output transistor of the Brokaw cell.

The circuit of the invention can effectively eliminate the risk of a missed start-up of the Brokaw cell circuit while ensuring, according to a preferred embodiment, a substantially constant current delivered to the load during the entire start up phase of the circuit. Accordingly, the output voltage increases linearly until reaching its steady state value.

BRIEF DESCRIPTION OF THE DRAWINGS

These and other characteristics and advantages of the circuit of the invention will become even more evident through the following detailed description of some embodiments, and by referring to the annexed drawings, wherein.

DETAILED DESCRIPTION OF THE PREFERRED EMBODIMENTS

Figure 1:
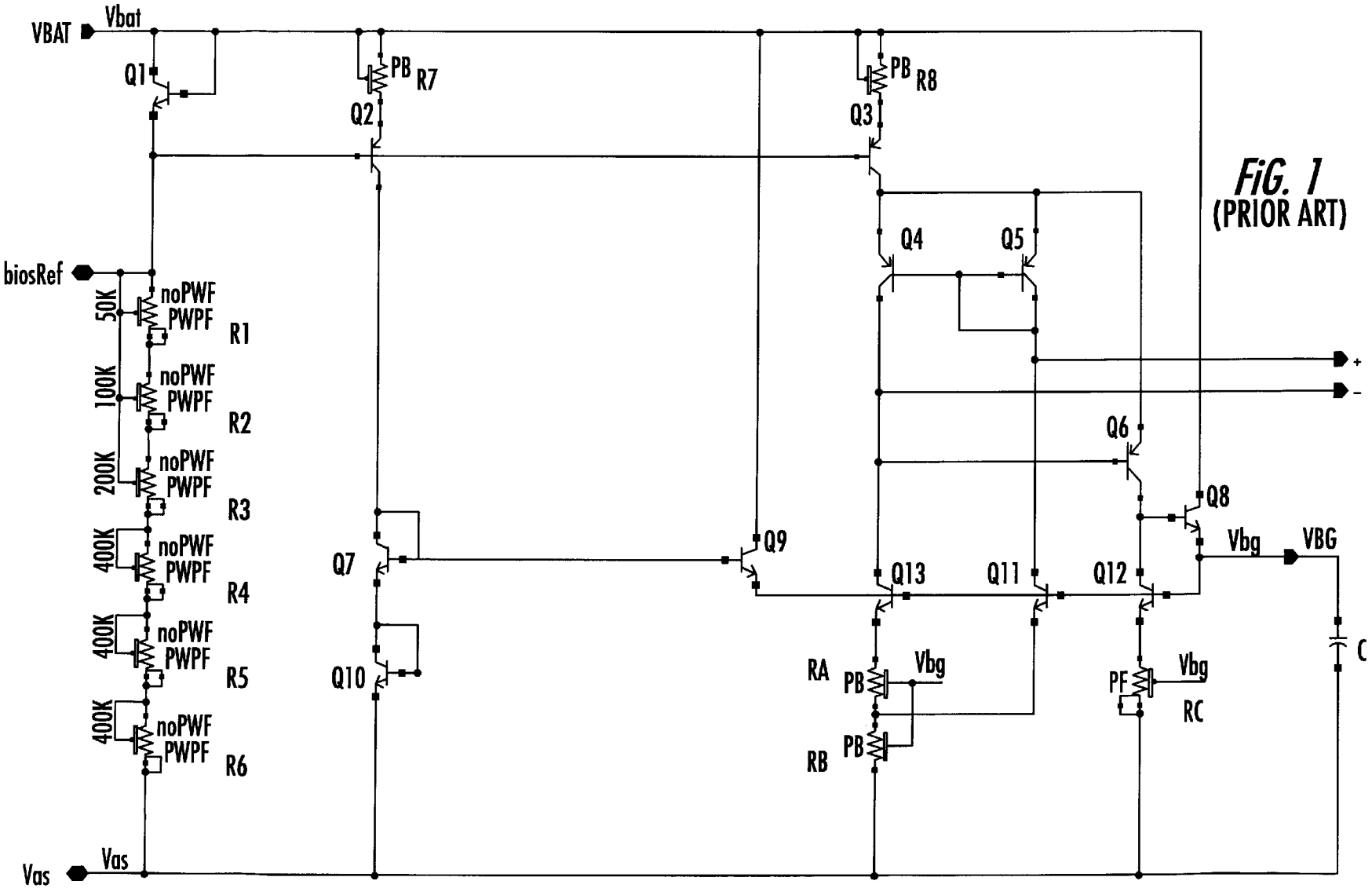
FIG. 1 (PRIOR ART)
FIG. 1, as already mentioned, is a typical scheme of a reference voltage generator independent of temperature varrations employing a Brokaw cell as in the prior art.

To better illustrate the characteristics of the invention it will be useful to reconsider some aspects of the circuits that generate a temperature independent reference voltage using a Brokaw cell according to the known technique by referring to FIG. 1. The circuit that is commonly referred to as Brokaw cell, is provided by the transistors Q4, Q5, Q6, Q8, Q13, Q11, Q12 and by integrated resistors RA, RB and RC. The circuit is widely used to generate a reference voltage independent of the temperature.

As already discussed above, these circuits present the following drawbacks. First, the current generator provided by the transistor Q3 supplies to the bandgap cell the necessary current for its functioning, but it does not control in anyway the supply voltage of the cell. Therefore, if the Vbat voltage varies, the voltage on the collectors of Q11 and Q13 rises linearly and the Early effect increases the respective collector currents, thus rendering inaccurate the final bandgap voltage (Vbg) that becomes dependent on the supply voltage.

Figure 3:
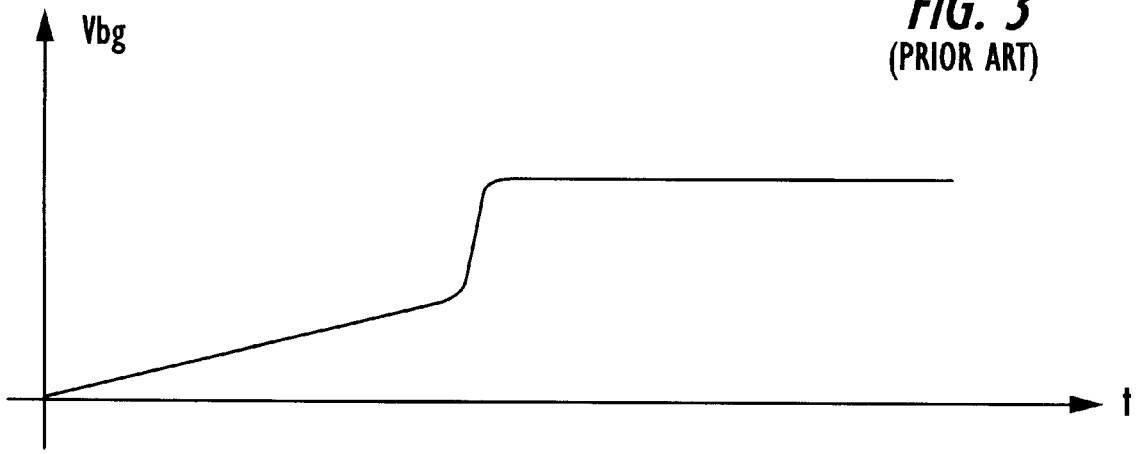
FiG. 3 (PRIOR ART)
FIG. 3 shows the output voltage characteristic, that is, the bandgap voltage produced by a circuit realized according to the prior art technique as shown FIG. 1.

The start-up is rather critical because of the reasons already mentioned above. Before the circuit is started, the load current is delivered by the transistor Q9 that then switches off when the start-up has taken place. The characteristic curves of the bandgap voltage developed by the prior art circuit is shown in FIG. 3.

Figure 2:
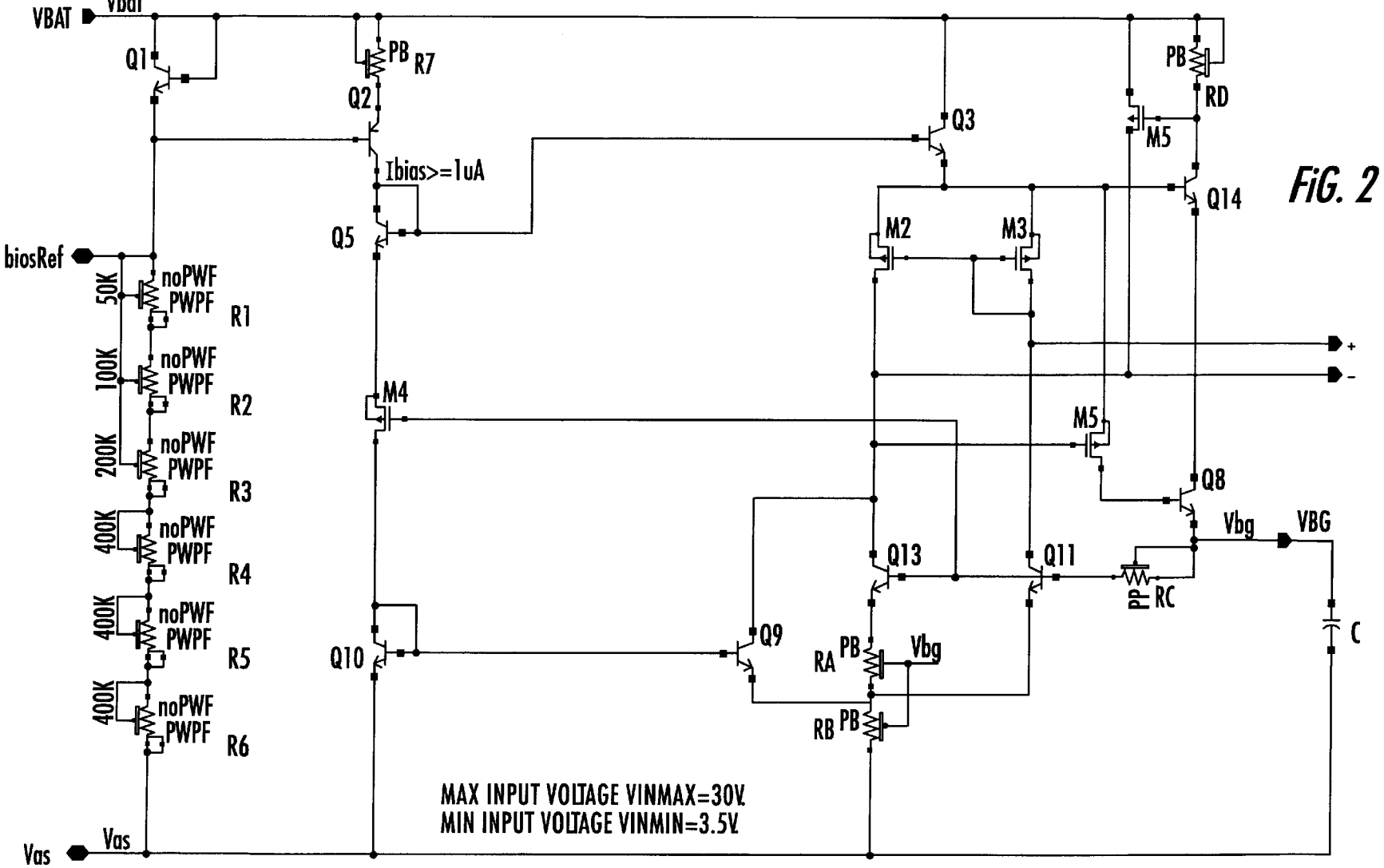
FIG. 2 is the circuit diagram of a reference voltage generator functionally comparable to the known circuit of FIG. 1, but realized according to the present invention.

The modified circuit of the present invention is depicted in FIG. 2. For the sake of precision, the BJTS Q4, Q5 and Q6 of the circuit diagram of the Brokaw cell of FIG. 1 are replaced with p-channel MOS transistors M2, M3 and M5. The cell's circuit remains substantially unchanged, but what is modified is the start-up circuit and the control circuit of the supply voltage of the pair of transistors of the bandgap cell (Brokaw cell).

A branch of the start-up circuit is used according to a fundamental aspect of the invention, to create a feedback loop that keeps stable the supply voltage of the cell. Indeed, the gate of the p-channel MOS transistor M4 is connected to the bandgap voltage node and its source is connected to an npn bipolar junction transistor Q5, connected in a diode configuration. Its base will always be at a voltage given by:

$$V=Vbg+Vgs(M4)+Vbe(Q_5)$$

Therefore, if to the base is connected another bipolar junction transistor Q3 of npn type, whose emitter supplies current to the bandgap cell, the supply voltage of the cell will always be constant and given by:

$$Vcell=Vbg+Vgs(M4)$$

The voltage error due to the Early effect of the bipolar junction transistors caused by variations of the reference voltage is thereby effectively made null, and the bandgap voltage developed by the cell no longer varies with the supply voltage. This is different than what happens in the prior art circuit of FIG. 1.

The start-up takes place through the BJT Q9. At the beginning, by way of its collector, Q9 maintains the voltage on the M5 transistor gate relatively low. This, therefore, injects current into the base of the output npn transistor Q8. This injected current is limited to the maximum current that may originate from the BJT Q14, which is driven through its base by Q3, which in turn is driven supplied by Q2. In substance, very little current injected into the base of Q3 is sufficient to deliver current to both the bandgap cell and to the base of Q14 and to be able to deliver several milliamps to the load of the bandgap reference circuit.

The problem of injecting into the bases of the Q11 and Q13 (in the embodiment shown) a current sufficient to overcome their parasitic pnp transistor as discussed in connection with the prior art circuit of FIG. 1, is easily satisfied by the advantageous capacity of the invention for delivering an output current.

Such an output current that is delivered at start-up, under conditions of practically a null voltage, may cause an excessive overshoot in output voltage during the start-up phase. To limit this, a p-channel MOS transistor M6, functionally connected to the collector Q14, as shown in the figure, may be optionally employed.

This optional anti-overshoot transistor is able to control efficiently the output current. The output current is limited to a maximum value which may be preestablished by choosing an appropriate value of the RD resistor connected between its gate and the supply rail. The resistor value may be set to proportionally raise the voltage on the gate M5, that is, for acting in opposition to the start-up BJT Q9.

Figure 4:
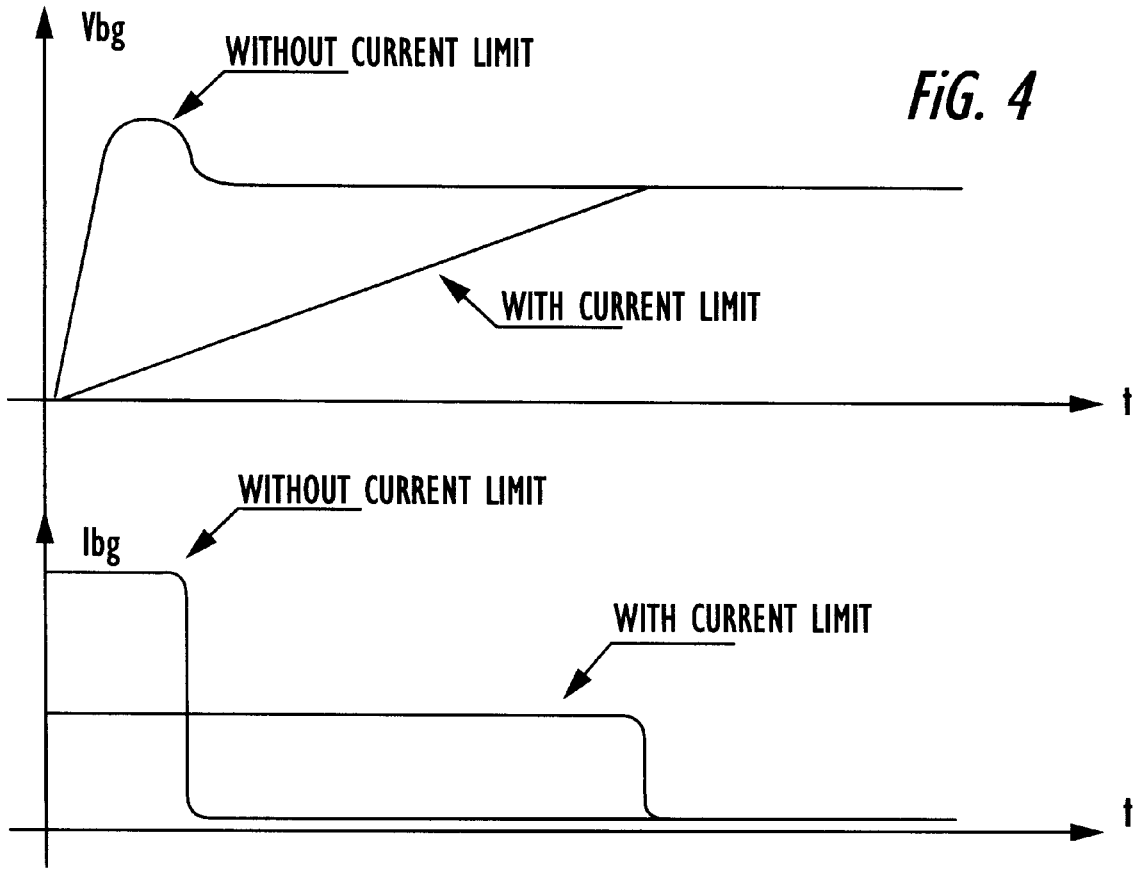
FIG. 4 shows the output voltage characteristic as well as the current delivered to the load of the circuit, for an implementation with and without current limiting means.

The results may be observed in FIG. 4. The current delivered to the load is constant during the whole start-up phase. Accordingly, the output voltage grows linearly until reaching its steady state value without voltage overshoot.

Figure 5:
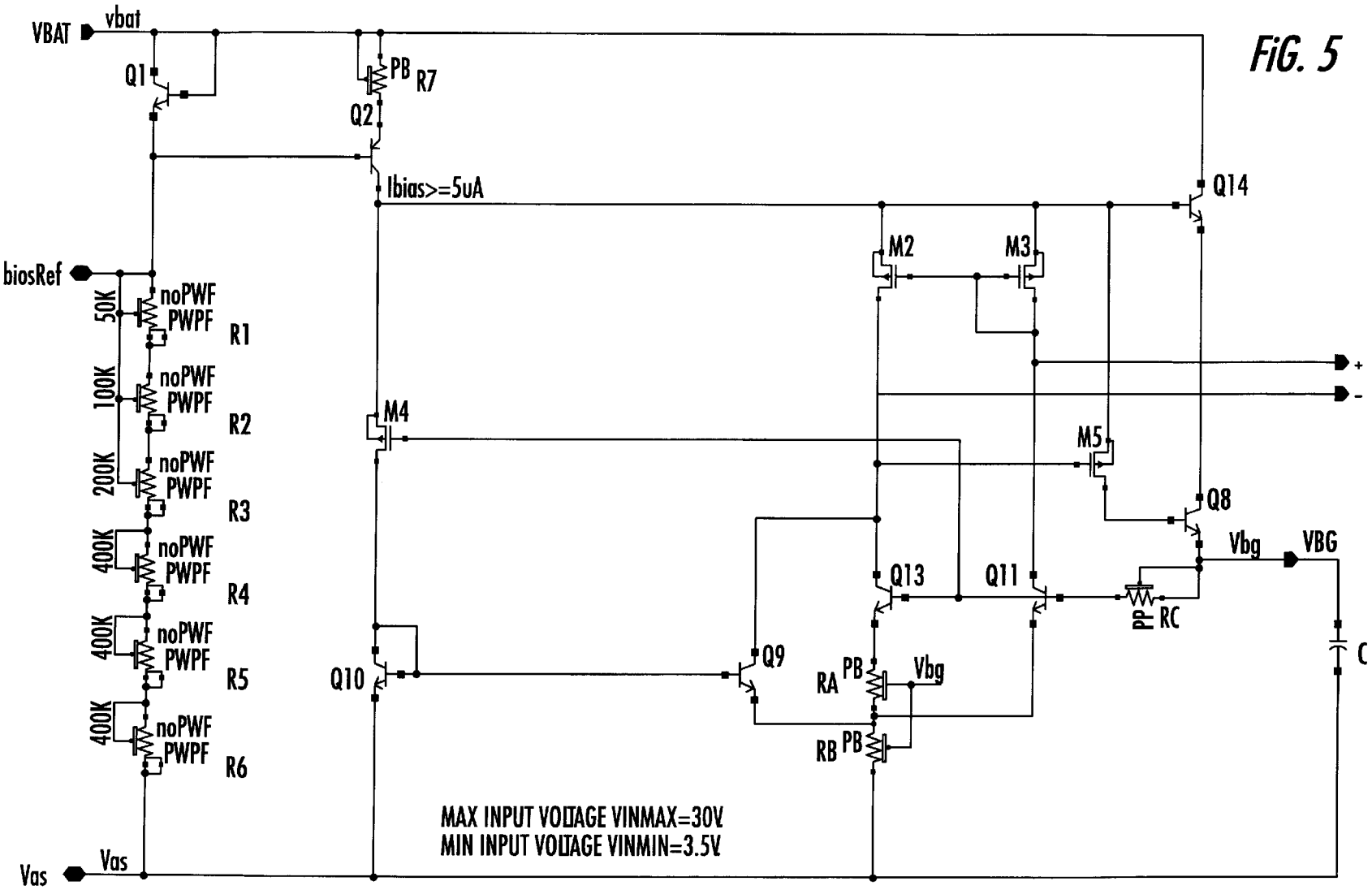
FIG. 5 shows a simplified circuit diagram of the generator circuit of the invention.

Basically a feedback loop is created which keeps constant the supply voltage of the bandgap cell. The circuit of the invention may be realized even in a simplified manner, as shown in FIG. 5. Though even with some limited penalizations, the circuit still Ad provides a bandgap voltage reference circuit that is able to function with a supply voltage lower by a Vbe as compared to the prior art circuit and equal to approximately:

$$Vbat=Vbg+Vgs_{(M4)}+Vcesat_{(Q2)}+\Delta Vrpb$$

Where ΔVRpb is the drop over the resistance connected between the emitter of the unified current generator Q2 and the supply rail.

It should also be noted that the current amplifying effect of the BJT Q3 is missing in the simplified embodiment of FIG. 5. Therefore the base currents of the transistors Q14 and Q8 plus the bias currents of the bandgap cell and that of the start-up branch must be entirely supplied by the Q2 generator. This requires that the value of the emitter resistance Rpb be dimensioned accordingly.

The reference voltage generator circuit described and illustrated in FIGS. 2 and 5 has been integrated on silicon and the results obtained have confirmed the evaluation results. The technology used was the so-called BCD technology, with a "line width" of 1.2 $\mu$m. The circuit of FIG. 2 functions with a minimum Vbat of 3V, while the one of FIG. 5 is able to function with just 2.5V.

That which is claimed is:

1. A generator circuit for a reference voltage independent of temperature variations, the generator circuit comprising:

a Brokaw cell having a bandgap voltage node and a power supply node and comprising an output transistor; and a start-up circuit for delivering a current to a load from a power-on instant until a switching on of said Brokaw cell and a consequent switching-off of the start-up circuit, said start-up circuit comprising at least one diode, a first biasing current generator, a field effect transistor having a gate coupled to the bandgap voltage node of said Brokaw cell and being operatively connected in series with said at least one diode and said first biasing current generator, a load resistance, and a bipolar junction transistor having a base coupled to the power supply node of said Brokaw cell and being operatively connected in series with said load resistance and the output transistor of said Brokaw cell for supplying current to the load during start-up.

2. A generator circuit according to claim 1, wherein said Brokaw cell further comprises a field effect driving transistor connected to the output transistor of said Brokaw cell; and further comprising an anti-overshoot field effect transistor having a gate coupled to a collector of said bipolar junction transistor, a source connected to a supply voltage and a drain connected to a gate of the field effect driving transistor.

3. A generator circuit according to claim 1, wherein said Brokaw cell further comprises a current mirror circuit; and wherein said current mirror circuit comprises a pair of field effect transistors.

4. A generator circuit according to claim 1, wherein said first current generator is connected to bias said Brokaw cell.

5. A generator circuit according to claim 1, further comprising a second current generator for biasing said Brokaw cell.

6. A generator circuit according to claim 5, wherein said at least one diode comprises first and second diodes connected in series with the first field effect transistor.

7. A generator circuit for a reference voltage independent of temperature variations, the generator circuit comprising:

a Brokaw cell having a bandgap voltage node and a power supply node and comprising an output transistor and a field effect driving transistor for the output transistor;

a start-up circuit for delivering a current to a load from a power-on instant until a switching on of said Brokaw cell and a consequent switching-off of the start-up circuit, said start-up circuit comprising at least one diode, a first biasing current generator, a field effect transistor having a gate coupled to the bandgap voltage node of said Brokaw cell and being operatively connected in series with said at least one diode and said first biasing current generator, a load resistance, and a bipolar junction transistor having a base coupled to the power supply node of said Brokaw cell and being operatively connected in series with said load resistance and the output transistor of said Brokaw cell for supplying current to the load during start-up; and an anti-overshoot circuit for preventing overshoot of a load voltage during start-up.

8. A generator circuit according to claim 7, wherein said anti-overshoot circuit comprises an anti-overshoot field effect transistor having a gate coupled to a collector of said bipolar junction transistor, a source connected to a supply voltage, and a drain connected to a gate of the field effect driving transistor.

9. A generator circuit according to claim 7, wherein said Brokaw cell further comprises a current mirror circuit; and wherein said current mirror circuit comprises a pair of field effect transistors.

10. A generator circuit according to claim 7, wherein said first current generator is connected to bias said Brokaw cell.

11. A generator circuit according to claim 7, further comprising a second current generator for biasing said Brokaw cell.

12. A generator circuit according to claim 11, wherein said at least one diode comprises first and second diodes connected in series with the first field effect transistor.

13. A generator circuit for a reference voltage independent of temperature variations, the generator circuit comprising:

a Brokaw cell having a bandgap voltage node and a power supply node and comprising an output transistor;

a first current generator for biasing said Brokaw cell; and a start-up circuit for delivering a current to a load from a power-on instant until a switching on of said Brokaw cell and a consequent switching-off of the start-up circuit, said start-up circuit comprising at least one diode, a second biasing current generator, a field effect transistor having a gate coupled to the bandgap voltage node of said Brokaw cell and being operatively connected in series with said at least one diode and said second biasing current generator, a load resistance, and a bipolar junction transistor having a base coupled to the power supply node of said Brokaw cell and being operatively connected in series with said load resistance and the output transistor of said Brokaw cell for supplying current to the load during start-up.

14. A generator circuit according to claim 13, wherein said Brokaw cell further comprises a field effect driving transistor connected to the output transistor of said Brokaw cell; and further comprising an anti-overshoot field effect transistor having a gate coupled to a collector of said bipolar junction transistor, a source connected to a supply voltage, and a drain connected to a gate of the field effect driving transistor.

15. A generator circuit according to claim 13, wherein said Brokaw cell further comprises a current mirror circuit; and wherein said current mirror circuit comprises a pair of field effect transistors.

16. A generator circuit according to claim 13, wherein said at least one diode comprises first and second diodes connected in series with the first field effect transistor.

* * * * *